US005210009A

United States Patent [19]

McGuckin et al.

[11] Patent Number: 5,210,009

[45] Date of Patent: May 11, 1993

[54] SILVER RECOVERY ELEMENT AND PROCESS

[75] Inventors: Hugh G. McGuckin; John S. Badger, both of Rochester, N.Y.

[73] Assignee: Eastman Kodak Company, Rochester, N.Y.

[21] Appl. No.: 724,393

[22] Filed: Jun. 28, 1991

[51] Int. Cl.[5] ..... G03C 5/31; C22B 3/44

[52] U.S. Cl. ..... 430/399; 430/398; 430/400; 430/488; 75/713; 266/170

[58] Field of Search ..... 430/398, 399, 400, 488; 75/713; 210/508; 266/170

[56] References Cited

U.S. PATENT DOCUMENTS

| | | | |
|---|---|---|---|
| 3,173,789 | 3/1965 | King et al. | 430/488 |
| 3,179,517 | 8/1959 | Tregillus et al. | 430/206 |
| 3,834,546 | 9/1974 | Brun et al. | 210/321 |
| 4,038,080 | 7/1977 | Fisch et al. | 430/398 |
| 4,227,681 | 10/1980 | Golben | 266/170 |
| 4,325,732 | 4/1982 | Woog | 75/109 |
| 4,882,056 | 11/1989 | Degen et al. | 210/490 |
| 4,988,448 | 1/1991 | Woog | 210/665 |

FOREIGN PATENT DOCUMENTS

| | | |
|---|---|---|
| 64-50047 | 2/1989 | Japan . |
| 940169 | 10/1963 | United Kingdom . |
| 1144481 | 3/1969 | United Kingdom . |

*Primary Examiner*—Charles L. Bowers, Jr.
*Assistant Examiner*—Mark F. Huff
*Attorney, Agent, or Firm*—L. George Legg

[57] ABSTRACT

An element and a process for recovering silver from a photographic developer solution containing silver ions. The silver recovery element (10) comprises a support (12) having a hydrophilic colloid layer (16) containing physical development nuclei on at least one of two opposing outer surfaces. Raised portions (20) space adjacent surfaces in the element's rolled-up configuration. The element can be contacted with the developer solution to recover silver from the solution.

18 Claims, 4 Drawing Sheets

FIG. 1
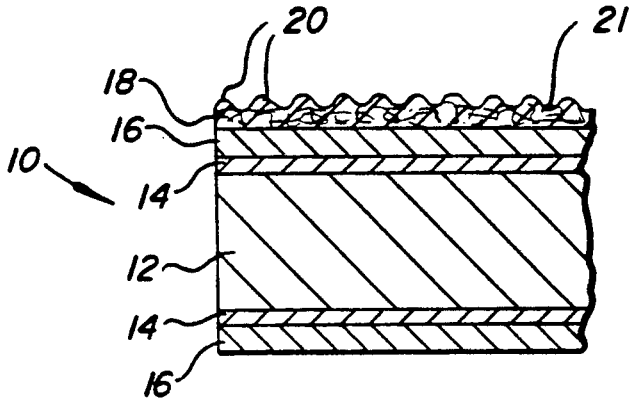
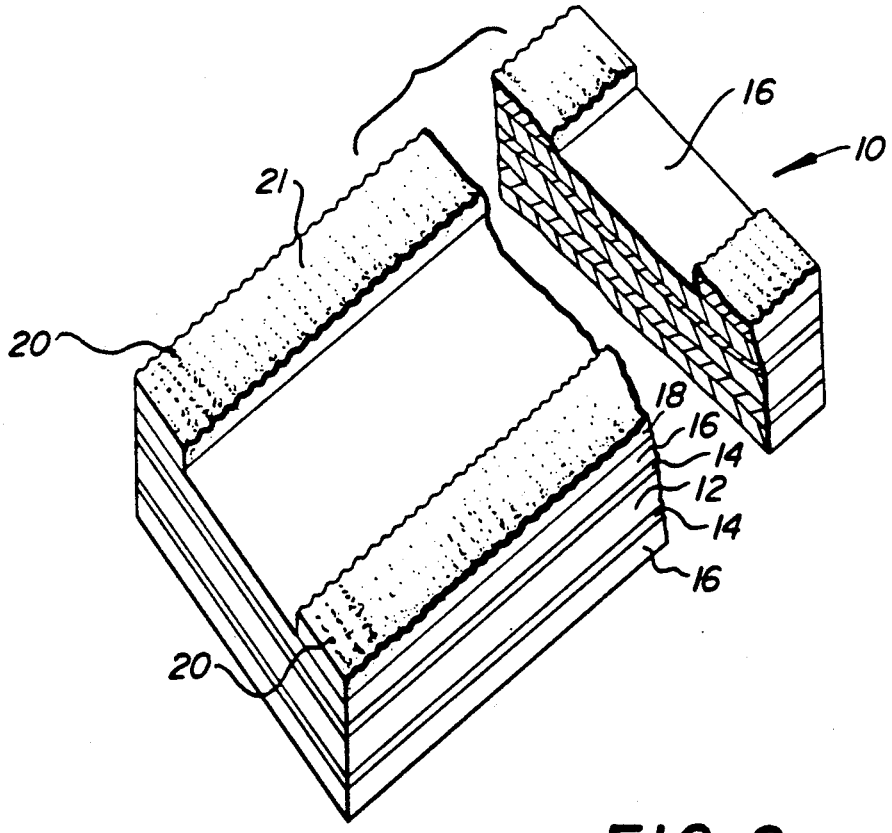
FIG. 2

FIG. 3
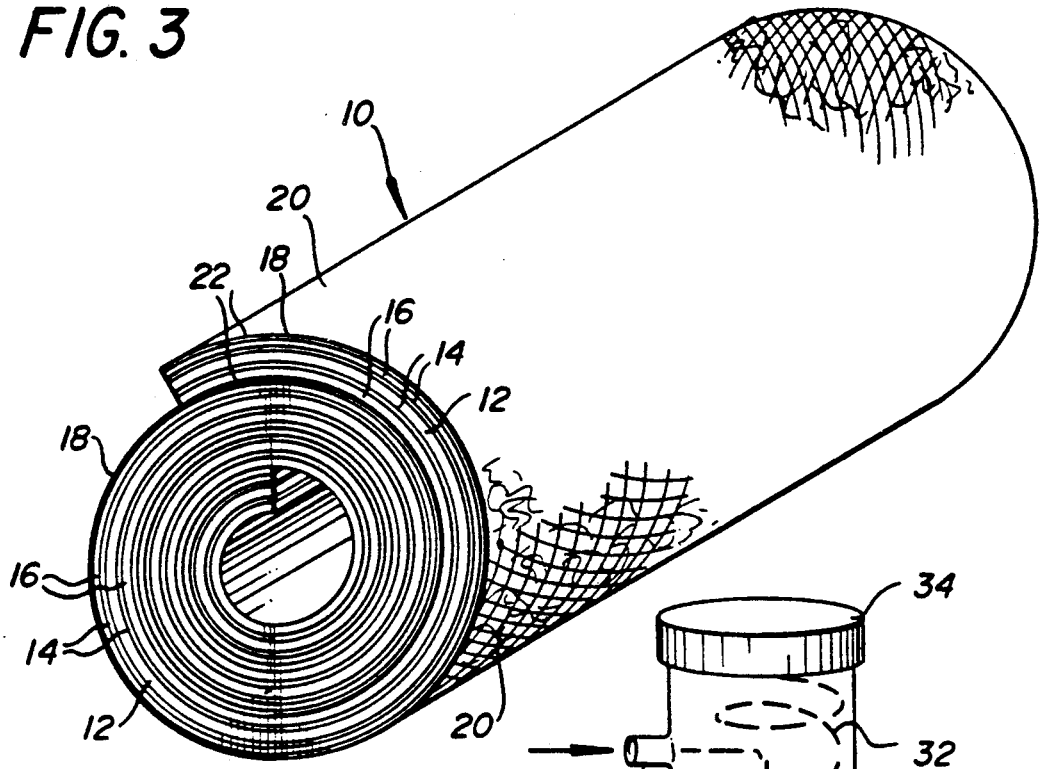
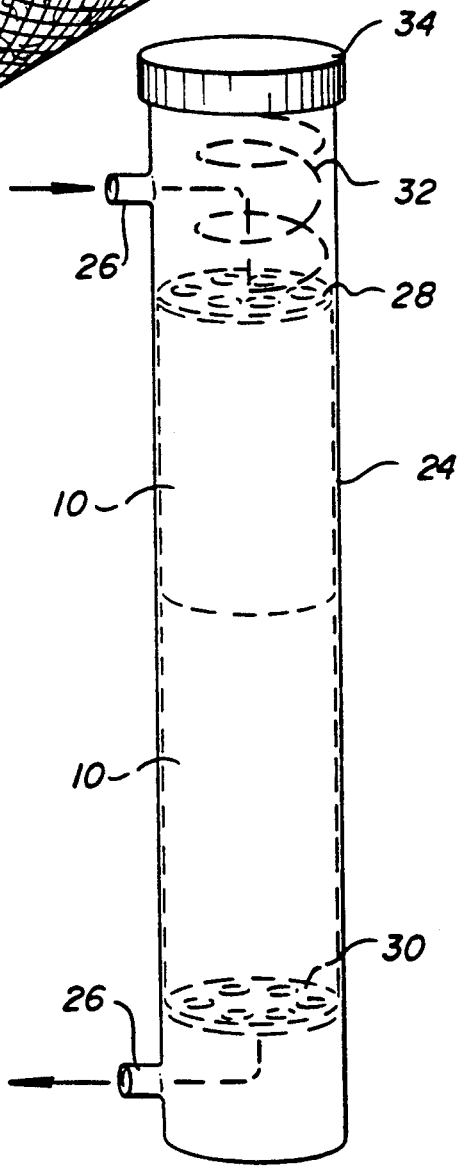
FIG. 4

SILVER RECOVERY ELEMENT AND PROCESS

FIELD OF THE INVENTION

The instant invention relates to an element and a process for recovering silver from a photographic developer solution containing silver ion. In particular, it relates to the use of a silver recovery element comprising a support having a hydrophilic colloid layer containing physical development nuclei on at least one of two opposing outer surfaces. The element has raised portions that space adjacent surfaces in the element's rolled-up configuration. The element can be contacted with a photographic developer solution to recover silver from the solution.

BACKGROUND OF THE INVENTION

Photographic developer solutions can contain undesirably high amounts of silver. Silver lost in effluent streams can present an economic cost as well as an environmental discharge concern. A seasoned photographic developer solution containing silver can also contain sulfite, which can react with silver in a photographic element to increase the amount of silver complex in solution. The silver complex tends to undergo reduction and form silver sludge. Silver sludge is a problem because it can decrease the practical useable lifetime of the developer solution. The silver sludge can foul developer apparatus such as rollers and belts and the like, and consequently foul photographic materials in contact with such apparatus, resulting in poor photographic quality. Silver sludge can also interfere with the flow of developer solution, resulting in poor photographic finish. Silver sludge formation on the developer apparatus and on the walls of the development tanks can necessitate more frequent maintenance and cleaning and result in more down time of the apparatus.

Efforts to minimize silver sludge formation have met with limited success. Some prior art methods employ the addition of mercapto or related compounds to the developer solution to inhibit the formation of silver sludge. A problem with this approach is that such additives can inhibit photographic development and decrease sensitivity. Another problem is that mercapto compounds tend to oxidize, which decreases the silver sludge-inhibiting effects.

Another prior art approach is the use of such mercapto compounds as a component in a photographic emulsion layer. This, however, can result in loss of photographic performance, such as speed and sensitivity loss.

Another prior art approach for recovering silver from a photographic developer solution employs a film having a hydrophilic colloid layer which contains a compound, such as a mercapto compound, capable of adsorbing silver. This can also have the above-noted problems concerning mercapto or related silver adsorbing compounds.

Also known is the use of physical development nuclei (sometimes termed active nuclei), such as Carey Lea Silver, as silver precipitating agents. They can be used to cause silver sludge to settle to the bottom of a development tank. This approach, however, does not result in satisfactorily decreasing, or eliminating, the problem of silver sludge formation.

Another prior art approach is to provide a silver precipitating layer in a photographic element having an image-forming silver halide layer. The silver precipitating layer, which can comprise a hydrophilic colloid containing metal sulfides or colloidal metals, e.g. Carey Lea silver, can decrease the migration of silver or silver halide and lessen silver buildup in a photographic developer solution. A problem with this approach is that silver and silver halide captured in the precipitating layer can impede light transmission and result in decreasing the photographic quality of the exposed film and developed image.

Also known is a processing element comprising a hydrophilic element containing a dispersed silver-precipitating agent, for example a physical development nuclei such as Carey Lea silver. The element is used, however, in a diffusion transfer photographic development process and not for silver recovery from an aqueous solution.

RELATED ART

U.S. Pat. No. 3,179,517 discloses a diffusion transfer photographic development process employing a processing element comprising a hydrophilic element, with or without a support, containing dispersed silver-precipitating agent, e.g. physical development nuclei such as Carey Lea silver. U.S. Pat. No. 3,173,789 discloses a method and composition for inhibiting silver sludge in thiosulfate monobaths by using mercapto compounds in the monobath composition.

U.S. Pat. No. 4,325,732 discloses a metal recovery apparatus and method employing an exchange mass within which is dispersed particles of a replacement metal.

U.S. Pat. No. 4,227,681 discloses a silver recovery cartridge having a metallic filler and a porous pad thereon.

U.S. Pat. No. 4,882,056 discloses a fluid treatment element comprising a permeable cartridge with a permeable core on which is disposed polymeric microfibers.

U.S. Pat. No. 4,038,080 discloses a desilvering method in which metallic silver or other particulate material can be added to a silver containing solution to supply nucleating sites for the silver in solution.

U.S. Pat. No. 3,834,546 discloses a semi-permeable fluid separation apparatus comprising a core, a textile sheath, and a semi-permeable membrane.

U.S. Pat. No. 4,988,448 discloses a method and apparatus for removing constituents from a waste solution, which apparatus comprises a cylindrical housing with an inlet, an outlet, and a filter material such as rolled fiberglass.

Jap. Published Patent Appl'n. 89-50047 discloses a cleaning film and method for preventing the production of silver sludge in a development solution. The cleaning film is described as having a hydrophilic colloid layer which contains a compound that can adsorb silver ions or silver metal above a substrate. It does not describe Applicants' method or assembly employing a media containing physical development nuclei to treat developer solutions.

U.K. 940,169 discloses developer additive compounds for preventing the formation of precipitates in photographic developers.

U.K. 1,144,481 discloses a monobath solution comprising o-mercaptobenzoic acid to control the formation of sludge.

SUMMARY OF THE INVENTION

The invention provides a silver recovery element for recovering silver from a photographic developer solution containing silver ions, comprising a support having two opposed surfaces; a hydrophilic colloid layer containing physical development nuclei on at least one of the two opposed surfaces; and a raised portion on at least one of the opposed outer surfaces of the element for spacing adjacent surfaces. The element is in a rolled-up configuration in which adjacent layers are spaced apart by the raised portions.

The invention also provides a process for recovering silver from a photographic developer solution containing silver ions. The process comprises contacting the solution with a silver recovery element as described above for a time sufficient to reduce the silver concentration in the solution to a desired level.

The hydrophilic colloid layer can be gelatin. In one embodiment of the invention, Carey Lea silver is employed in a coverage of from about 430 mg/m$^2$ to about 1075 mg/m$^2$ of the hydrophilic colloid, e.g. gelatin. The Carey Lea silver can have an average diameter in the range of from about 10 Å to about 500 Å.

The invention has several advantages over prior art methods directed towards the problem of silver sludge formation in photographic developer solutions. The invention provides a material which when immersed in a developer solution serves as a catalytic surface for the physical development of complexed silver ion which would otherwise form silver sludge. It does not require the introduction into the developer solution of silver precipitating agents that can adversely affect photographic performance or development of the latent image. The invention restrains the plating out of silver on the surfaces of the developer tank and transport rollers.

The element and process of the invention also provide good silver removal to prolong the useful life of the developer solution and prevent the rapid change in solution color associated with the formation of silver sludge. It delays the need for cleaning the developer tank and rollers with a systems cleaner. The materials comprising the recovery element used in the process are readily available and economic to use.

BRIEF DESCRIPTION OF THE DRAWINGS

FIG. 1 is a fragmentary, cross-sectional view of a silver recovery element of the invention.

FIG. 2 is an enlarged, fragmentary, cross-sectional view of the silver recovery element of FIG. 1.

FIG. 3 is a schematic view of a silver recovery element of the invention in a rolled-up configuration.

FIG. 4 is a schematic view of a developer canister containing two of the silver recovery elements illustrated in FIG. 3.

DESCRIPTION OF PREFERRED EMBODIMENTS

Figure 5:
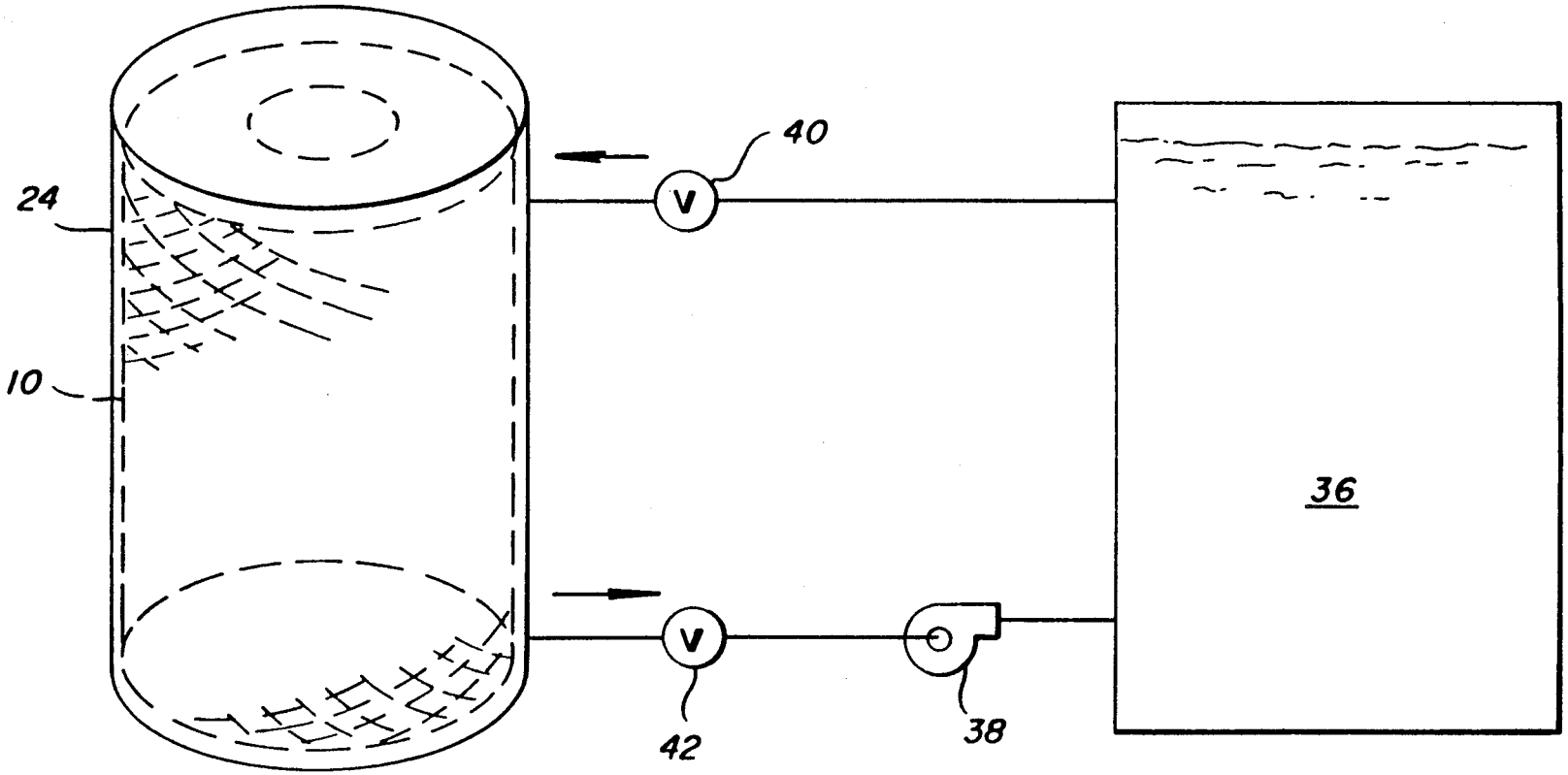
FIG. 5 is a schematic diagram of a photoprocessing developer recirculation system containing the developer canister of FIG. 4.

The present invention provides a silver recovery element for recovering silver from a photographic developer solution containing silver ions, such element comprising: a support having two opposed surfaces; a hydrophilic colloid layer containing physical development nuclei on at least one of the two opposed surfaces; a raised portion on at least one of the opposed outer surfaces of the element for spacing adjacent surfaces; and wherein the element has an active surface to volume ratio in excess of the outer surface to volume ratio defined by the geometric configuration of the element.

The present invention also comprises a process for recovering silver from a photographic developer solution containing silver ions, such process comprising contacting the solution with a silver recovery element, the element comprising a support having two opposed surfaces; a hydrophilic colloid layer containing physical development nuclei on at least one of the two opposed surfaces; a raised portion on at least one of the opposed outer surfaces of the element for spacing adjacent surfaces; and wherein the element has an active surface to volume ratio in excess of the outer surface to volume ratio defined by the geometric configuration of the element; and the contacting being for a time sufficient to reduce the concentration of silver in the solution to a desired level.

The element can be positioned inside a housing having an inlet port and an outlet port for respectively providing solution to and discharging solution from the housing.

The substrate must be inert, that is, it must be substantially nonreactive with the hydrophilic colloid, the physical development nuclei, and and the developer solution. One skilled in the art can select an inert substrate. An optional subbing layer can be employed between the substrate and the hydrophilic colloid layer. Exemplary useful substrates, for example poly(ethylene terephthalate) ("PET"), and subbing layer materials and techniques are described in *Research Disclosure*, Kenneth Mason Publications, Ltd., Emsworth, England, Volume 308, December 1989, Item 308119, section XVII, incorporated by reference as if fully set forth herein.

The physical development nuclei can comprise any suitable wellknown agent which does not exert adverse effects on the photographic element. Physical development nuclei are well known in the art, e.g., as set forth in U.S. Pat. 3,737,317 and U.S. Pat. No. 3,179,517. Typical physical development nuclei useful in the practise of the invention include metal sulfides, metal selenides, metal polysulfides, metal polyselenides, stannous halides, heavy metals and heavy metal salts and mixtures thereof. Heavy metal sulfides such as lead, silver, zinc, antimony, cadmium and bismuth sulfides are useful. In one embodiment of the invention, nickel sulfide is employed as the physical development nuclei.

Heavy metals, e.g. noble metals, are useful as physical development nuclei in the invention, such as silver, gold, platinum, and palladium and mixtures thereof, preferably in the colloidal form. In one embodiment the noble metal can comprise particles of colloidal silver, such as Carey Lea silver.

The amount of physical development nuclei in the hydrophilic layer can be selected based on factors such as activity, dispersability of the nuclei in the layer, cost of fabrication of the recovery element, desired removal efficiency of the element, and so forth. In one embodiment the physical development nuclei comprises Carey Lea silver in an amount from about 430 mg/m$^2$ to about 1075 mg/m$^2$.

The size of the physical development nuclei can be selected based on performance factors for the particular type of physical development nuclei selected. For example, Carey Lea silver nuclei having an average pre-treatment diameter in the range of from about 10 Å to about 500 Å are useful as physical development nuclei in the invention. By "average pre-treatment diameter" is meant the average diameter of Carey Lea silver nuclei prior to the use of the silver recovery element to treat a silver-containing solution. During treatment the average diameter should increase because silver is removed from solution and accumulates on or near the Carey Lea silver nuclei. Too low a diameter can have the effect of increasing the time to remove the desired amount of silver from solution. Too high a diameter can limit the effectiveness of the element in removing silver. A preferred average pre-treatment diameter is about 300 Å.

The hydrophilic colloid layer can comprise a hydrophilic colloid such as those disclosed in *Research Disclosure*, Kenneth Mason Publications, Ltd., Emsworth, England, Volume 308, December 1989, Item 308119, section IX, incorporated by reference as if fully set forth herein. Useful hydrophilic colloids include proteins, gelatin, and polysaccharides such as dextrin, to name but a few. In one embodiment of the invention, bone-derived gelatin is the hydrophilic colloid.

Typically, the hydrophilic colloid layer is cross-linkable and can further comprise a hardener as noted above. Alternatively or additionally, a hardener can be added to the developer solution. One skilled in the art can readily select a hardener that is compatible with the particular hydrophilic colloid, and when a different hardener is employed in the colloid layer and the developer solution, hardeners that are mutually compatible should be selected. Typical useful hardeners are those such as are disclosed in *Research Disclosure*, Kenneth Mason Publications, Ltd., Emsworth, England, Volume 308, December 1989, Item 308119, section X, incorporated by reference as if fully set forth herein. In one embodiment of the invention, bis vinylsulfonylmethyl ether, disclosed in U.S. Pat. No. 3,841,872 (Reissue No. 29,305), Burness et al, is a hardener used in the hydrophilic colloid layer.

The solution being treated by the element and process of the invention is a photographic developer solution containing silver ions. The solution can comprise a seasoned solution or an unseasoned solution.

When carrying out the process of the invention, the step of contacting the developer solution with the silver recovery element should be for a time sufficient to reduce the concentration of silver in the developer solution to a desired level. The desired final silver concentration and treatment time are readily determinable by the operator, and can be influenced by factors such as solution flow rate, starting silver concentration, and the efficiency and coating coverage of the physical development nuclei. In one embodiment, the treatment time to reduce silver concentration from about 80 mg/liter to about 25 mg/liter is about 4 hours, and from about 80 mg/liter to about 15 mg/liter is about 6 hours.

The process can be carried out at a temperature in the range of from about 50° F. (10° C.) to about 95° F. (35° C.). A preferred process temperature is in the range of from about 70° F. (21.1° C.) to about 95° F. (35° C.). The process can be conducted at any pressure in the range of from about atmospheric pressure for a stated set of reaction conditions to about 100 atmospheres.

FIGS. 1 and 2 illustrate silver recovery element 10 prior to fabrication to its final configuration as shown in FIG. 3. Referring first to FIGS. 1, 2, and 3, silver recovery element 10 comprises support 12 having two opposing surfaces each of which has coated thereon optional subbing layer 14. Hydrophilic colloid layer 16, e.g. gelatin, is coated on each subbing layer 14, or in the absence of subbing layer 14 onto an opposing surface of support 12. Layer 16 contains physical development nuclei such as Carey Lea silver and can also contain an optional hardener. A pair of spacer strips 18 having corrugated surfaces 20 are affixed on one of layers 16 along two opposing edges of element 10. In another embodiment (not illustrated), instead of employing corrugated spacer strips, element 10 can have a corrugated configuration, or alternatively element 10 can have corrugated or dimpled edges, to function as spacers between adjacent layers when element 10 is rolled up for use as a silver recovery unit. The latter embodiment is readily employable with a support material such as cellulose triacetate.

FIG. 3 illustrates element 10 fabricated into a convoluted structure rolled end to end like a roll of film for use in the practise of the invention. Adjacent element layers 22 are separated by spacer strips 18 as shown therein. Element 10 thus has an active surface to volume ratio in excess of the outer surface to volume ratio defined by the geometric configuration of the element, e.g., if the ends of element 10 were not rolled but instead were kept separated or just met. Corrugated surfaces 20 when rolled-up as so described form flow channels (not illustrated) for solution flow through furrows 21. FIG. 4 illustrates element 10 positioned in developer canister 24. Canister 24 can be positioned in a photoprocessing developer recirculation system, described below, wherein developer solution is provided to and returned from ports 26 as illustrated by the direction arrows. Distributor plates 28 and 30 are positioned as shown to distribute solution flow respectively into and out of elements 10 and as means for retaining elements 10. Retaining element 32 retains distributor plate 28 with respect to end cap 34. Solution flow into and out of recovery elements 10 is illustrated by the direction arrows.

FIG. 5 illustrates a photoprocessing developer recirculation system containing a silver recovery element of the invention, developer solution flow being indicated by the direction of flow arrows. Developer solution is provided to film developer tank 36 by recirculating pump 38. The developer solution flows through tank 36 in which exposed photographic film can be developed, through optional flow control valve 40, and to silver recovery canister 24 that contains recovery element 10. After flowing through recovery element 10, developer solution is recirculated through optional flow control valve 42 to pump 38. As stated above, the invention may also be practised without tank 36, that is, circulating developer solution through silver recovery canister 24 without tank 36 being connected into the system.

The invention is further illustrated by the following examples of its practice.

EXAMPLE 1

A 7 mil (0.18 mm) thick poly(ethylene terephthalate) support was sub-coated on both sides and each side coated on its sub-coat with the following formulation:

2000 mg/ft$^2$ (2.15 mg/cm$^2$) of 12.5% by weight photographic grade gelatin dispersion 20 mg/ft$^2$ (215.29 mg/m$^2$) of 2.0% by weight solution of bisvinylsulfonyl methylether (hardener)

Figure 6:
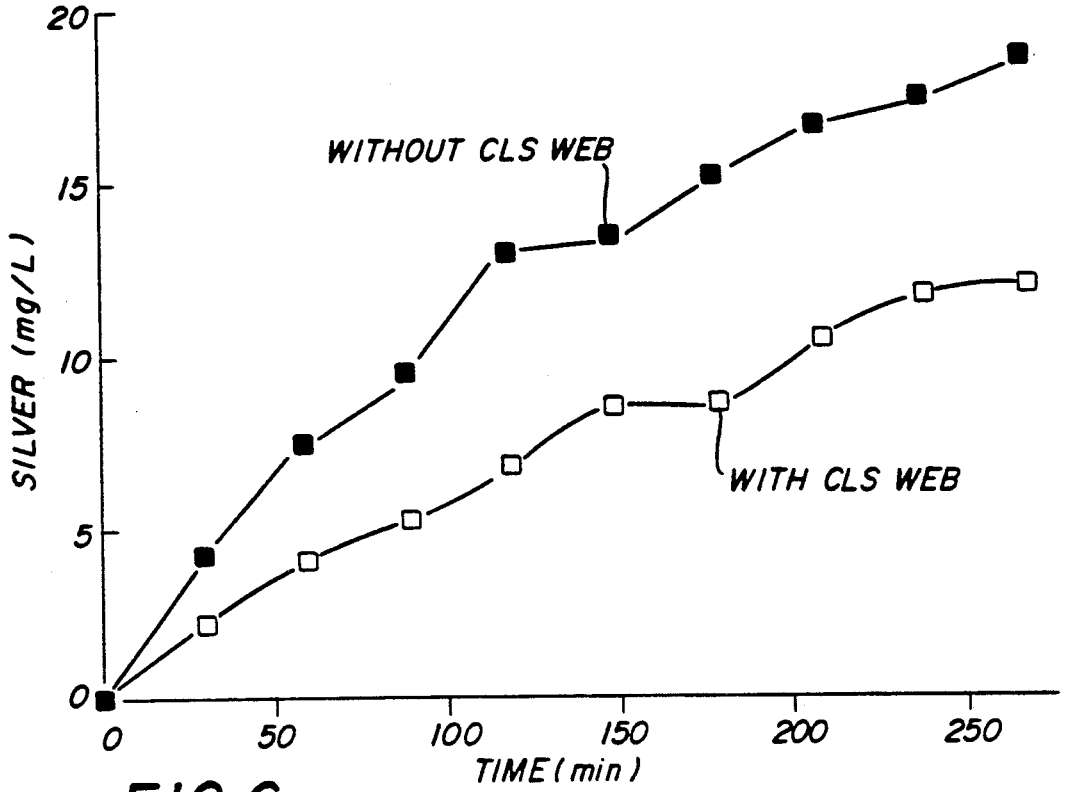
FIG. 6 is a graph comparing silver concentration in a developer solution versus processing time with and without using a silver recovery element of the invention.
Figure 7:
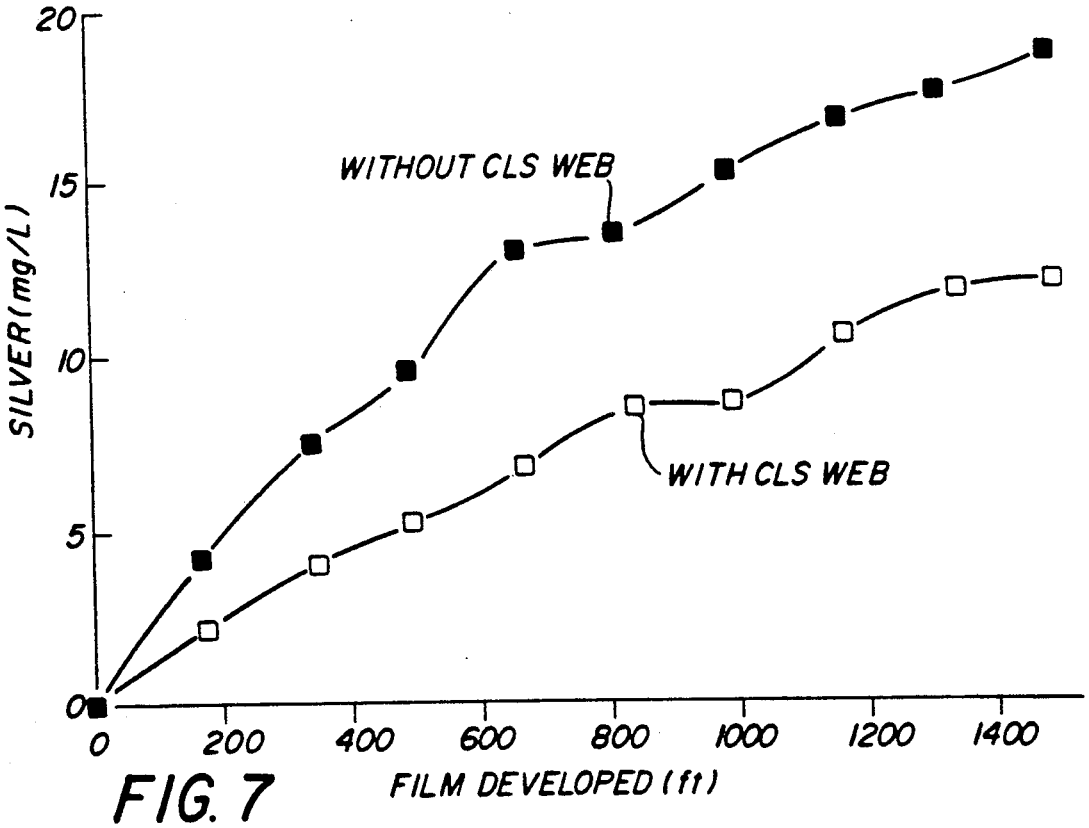
FIG. 7 is a graph comparing silver concentration in a developer solution versus the total length of processed film with and without using a silver recovery element of the invention.

60 mg/ft$^2$ (645.87 mg/m$^2$) of 4.9% Carey Lea silver in a 9 percent by weight of photographic grade gelatin dispersion A 60 mm thick acetate processing apron having a corrugated surface was affixed to the recovery element as in FIGS. 1 and 2 and the element rolled up as shown in FIG. 3. Two recovery elements were positioned in a canister, a "Lab Gas Drying Unit" manufactured by W. A. Hammond Dreirite Co., as illustrated in FIG. 4, and plumbed into a recirculation loop. The loop also contained a Kodak PROSTAR TM Film Processor that for each run processed about 1500 feet of unexposed Kodax Graphic Data microfilm at half-normal speed using Kodak PROSTAR developer and PROSTAR Fix. The flow rate of developer solution through the loop and the element was about 2 liter/min. Samples of developer were extracted at ½ hour intervals over a 4½ hour period and silver concentration analyzed by atomic absorption spectrophotometry at 70° F. (21.1° C.). The test was repeated but without the silver recovery element in the loop. The results are shown in Table I, below, and shown graphically in FIGS. 6 and 7.

TABLE I

| Time (hours) | Film feet (m) | Silver in Developer Solution Using No Recovery Element (mg/l): | Silver in Developer Solution Using Recovery Element (mg/l): | Percent Reduction |
|---|---|---|---|---|
| ½ | 175 (53.34) | 4.2 | 2.2 | 48 |
| 1 | 350 (106.68) | 7.5 | 4.0 | 47 |
| 1½ | 500 (152.4) | 9.5 | 5.2 | 45 |
| 2 | 675 (205.74) | 13.0 | 6.8 | 47 |
| 2½ | 825 (251.46) | 13.5 | 8.5 | 37 |
| 3 | 1000 (304.8) | 15.2 | 8.6 | 43 |
| 3½ | 1175 (358.14) | 16.7 | 10.5 | 37 |
| 4 | 1325 (403.86) | 17.5 | 11.8 | 32 |
| 4½ | 1500 (457.2) | 18.7 | 12.1 | 35 |

The test results in Example 1 show good silver recovery for the process of the invention as shown by the demonstrated decrease in silver concentration of the developer solution with the silver recovery element in place.

EXAMPLE 2

Another type of physical development nuclei, nickel sulfide, was also tested. A 4 mil (0.10 mm) thick subbed poly(ethylene terephthalate) support was coated with the following formulation:

2000 mg/ft$^2$ (2.15 mg/cm$^2$) of 12.5% by weight photographic grade gelatin dispersion 20 mg/ft$^2$ (215.29 mg/m$^2$) of 2.0% by weight solution of bisvinylsulfonyl methylether (hardener)

0.7 mg/ft$^2$ (7.54 mg/m$^2$) of nickel sulfide

To season a developer solution, thirty unexposed 8" by 10" sheets of KODALINE TM Rapid Film were individually tray processed at 110° F. (43.3° C.) in 1 liter of Kodak RA-2000 developer solution for 60 seconds with continuous agitation. Two hundred milliters of the seasoned developer solution were introduced into each of four beakers. A 15.2 cm×3.5 cm sample of the coated support was coiled and placed in the developer solution in each beaker. Each developer solution was stirred at about 800 rpm using a Sybron Thermolyne Multi-Stir Plate "4".

The silver concentration in solution was obtained by atomic absorption at 70° F. (21.1° C.) initially and at 1,2, and 3 hours. Silver analyses were also obtained for each of the coating samples by X-ray fluoresence initially and at 1,2, and 3 hours. The results are shown in Table 2, below. The silver concentration in solution decreased from 69.9 mg/liter to 51.4 mg/liter over the 3 hour period. The amount of silver physically developed in the coated support increased from 0 to 60.4 mg/ft$^2$ (242.20 mg/m$^2$) after 1 hour and 63.0 mg/ft$^2$ (650.17 mg/m$^2$) after 3 hours, demonstrating that as silver is removed from the developer solution it is physically developed in the coated support.

The results show that a physical development nuclei other than Carey Lea silver, e.g. nickel sulfide, is effective for recovering silver from solution.

TABLE 2

| Time (hours) | Silver Concentration in Developer Solution (mg/liter) | Silver Level in Coated Sample (mg/m$^2$) |
|---|---|---|
| Initial | 69.6 | 0 |
| 1 | 61.6 | 33.7 |
| 2 | 55.5 | 48.9 |
| 3 | 51.4 | 60.4 |

The present invention can be advantageously employed in treating photographic developer solutions containing silver ion. It provides significant benefits. For example, it does not require the introduction into a developer solution of silver precipitating agents that can adversely affect photographic performance or development of the latent image. The invention provides good silver removal to prolong the useful life of the developer solution. It does not require deploying a silver recovery layer in a photographic element which can adversely affect the photographic quality of the developed, exposed film.

The element and process of the invention are useful in removing silver from a photographic developer solution that could otherwise form silver sludge and foul the recirculator for the developer solution and other developer apparatus. This can result in improved performance of such apparatus, e.g. decreased time out of service and decreased maintenance. Improved uniformity of flow of the developer solution can also result, leading to higher photographic quality of the exposed, developed film. The invention is also useful in removing silver from an effluent stream and thus can help meet environmental discharge limits.

This invention has been described above with particular reference to preferred embodiments. A skilled practitioner familiar with the detailed description above, can make many substitutions and modifications without departing from the scope and spirit of the appended claims.

We claim:

1. A silver recovery element for recovering silver from a photographic developer solution containing silver ions, said element comprising: a support having two opposed surfaces; a hydrophilic colloid layer containing physical development nuclei on at least one of said two opposed surfaces; a raised portion on at least one of the opposed outer surfaces of said element for spacing adjacent surfaces; and wherein said element has an active surface to volume ratio in excess of the outer surface to volume ratio defined by the geometric configuration of said element.

2. The silver recovery element of claim 1, wherein said physical development nuclei is Carey Lea silver in an amount from about 430 $mg/m^2$ to about 1075 $mg/m^2$.

3. The silver recovery element of claim 1, wherein said physical development nuclei is Carey Lea Silver having an average diameter in the range of from about 10 Å to about 500Å.

4. The silver recovery element of claim 1, wherein said physical development nuclei comprises nickel sulfide.

5. The silver recovery element of claim 1, wherein said hydrophilic colloid layer contains a hardener.

6. The silver recovery element of claim 1, wherein said solution contains a hardener.

7. The silver recovery element of claim 1, wherein said solution is a seasoned photographic developer solution.

8. The silver recovery element of claim 1, wherein said element is positioned inside a housing, said housing having an inlet port and an outlet port for respectively providing said solution to and discharging said solution from said housing.

9. A process of recovering silver from a photographic developer solution containing silver ions, said process comprising contacting said solution with a silver recovery element, said element comprising: a support having two opposed surfaces; a hydrophilic colloid layer containing physical development nuclei on at least one of said two opposed surfaces; a raised portion on at least one of the opposed outer surfaces of said element for spacing adjacent surfaces; and wherein said element has an active surface to volume ratio in excess of the outer surface to volume ratio defined by the geometric configuration of said element; and said contacting being for a time sufficient to reduce the concentration of silver in said solution to a desired level.

10. The process of claim 9, wherein said hydrophilic colloid layer is gelatin.

11. The process of claim 9, wherein said physical development nuclei is Carey Lea silver in an amount from about 430 $mg/m^2$ to about 1075 $mg/m^2$.

12. The process of claim 9, wherein said physical development nuclei is Carey Lea Silver having an average diameter in the range of from about 10 Å to about 500 Å.

13. The process of claim 9, wherein said physical development nuclei comprises nickel sulfide.

14. The process of claim 9, wherein said hydrophilic colloid layer contains a hardener.

15. The process of claim 9, wherein said solution contains a hardener.

16. The process of claim 9, wherein said solution is a seasoned photographic developer solution.

17. In a photographic developer recirculating system having a developer tank and a recirculating pump, the improvement wherein said developer system further comprises a silver recovery element comprising a support having two opposed surfaces; a hydrophilic colloid layer containing physical development nuclei on at least one of said two opposed surfaces; a raised portion on at least one of the opposed outer surfaces of said element for spacing adjacent surfaces; and wherein said element has an active surface to volume ratio in excess of the outer surface to volume ratio defined by the geometric configuration of said element.

18. The photographic developer recirculating system of claim 17, wherein said element is positioned inside a housing, said housing having an inlet port and an outlet port for respectively providing a solution to and discharging a solution from said housing.

* * * * *